US005597321A

United States Patent [19]

Jacques

[11] Patent Number: 5,597,321

[45] Date of Patent: Jan. 28, 1997

[54] PUSH-IN CONNECTING PIECE AND TERMINAL STRIP EQUIPPED WITH SAME

[75] Inventor: Didier Jacques, La Francheville, France

[73] Assignee: Alcatel Cable Interface, Vrigne aux Bois, France

[21] Appl. No.: 409,589

[22] Filed: Mar. 24, 1995

[30] Foreign Application Priority Data

Mar. 30, 1994 [FR] France ..... 94 03786

[51] Int. Cl.[6] ..... H01R 4/24

[52] U.S. Cl. ..... 439/417

[58] Field of Search ..... 439/417–419

[56] References Cited

U.S. PATENT DOCUMENTS

| | | | |
|---|---|---|---|
| 4,652,070 | 3/1987 | Suffi . | |
| 4,781,618 | 11/1988 | Geib et al. | 439/417 |
| 4,808,122 | 2/1989 | Tomizu et al. | 439/417 |
| 4,820,191 | 4/1989 | Lacroix | 439/417 |
| 5,240,432 | 8/1993 | Daoud | 439/417 |
| 5,302,137 | 4/1994 | Suffi | 439/417 |
| 5,324,212 | 6/1994 | Fremgen et al. | 439/417 |
| 5,399,099 | 3/1995 | English et al. | 439/417 |

FOREIGN PATENT DOCUMENTS

| | | | |
|---|---|---|---|
| 2562337 | 10/1985 | France . | |
| 9310575 | 5/1993 | WIPO | 439/418 |

OTHER PUBLICATIONS

French Search Report FR 9403786.

*Primary Examiner*—P. Austin Bradley
*Assistant Examiner*—Jill Demello
*Attorney, Agent, or Firm*—Sughrue, Mion, Zinn, Macpeak & Seas

[57] ABSTRACT

The push-in connecting piece has at least one pair of elongate members integral with an actuating head and pierced in line with an insertion hole for an insulated wire and is fitted to slide over at least one insulation displacement contact. Each elongate member of the push-in piece has a slit made in the insertion hole thereof and directed towards the head, for gripping the insulated wire.

11 Claims, 7 Drawing Sheets

PUSH-IN CONNECTING PIECE AND TERMINAL STRIP EQUIPPED WITH SAME

The present invention relates to electrical connecting devices in which an insulated wire is connected to an insulation displacement contact by means of a push-in connecting piece carrying the insulated wire and sliding on the contact. More specifically, the invention concerns a push-in connecting piece of this type and a terminal strip equipped with such push-in pieces.

BACKGROUND OF THE INVENTION

The document FR-A-2 666 953 describes a terminal strip with insulation displacement contacts fitted in an insulating body and with push-in connecting pieces fitted to slide on the contacts. The insulating body has chimneys that open out in a "front" one of its faces, each chimney having one of the contacts extending therein. Each push-in connecting piece thus slides in one of the chimneys, along an insulation-piercing fork of the contact, between an inserted position connecting the insulated wire to the contact, and a withdrawn position for threading an insulated wire into the push-in connecting piece or disconnecting an insulated wire previously connected to the contact.

The push-in piece is either single, in which case it serves to connect one insulated wire to a contact, or else double, in which case it serves to connect two insulated wires simultaneously to two adjacent contacts of the terminal strip. The push-in piece, whether single or double, is made of plastic.

The single push-in piece has two facing longitudinal elongate members integral with an end actuating head and having mutually-aligned holes for threading the insulated wire through each of the elongate members. It also has a Vee to guide the insulated wire into the holes in the elongate members, this Vee being integral with the head and extending along the outside, in front of one of the members, with its bottom aligned with the holes and its opening facing towards the actuating head. The guiding Vee slides on the outside of one of the partitions of the chimney when the members slide on either side of the contact along the insulation-piercing fork of the contact.

To improve the mechanical strength of the insulated wire connected to the contact, a calibrated gripping slit is provided in the chimney wall along which the guiding Vee slides, to grip the insulated wire. It is therefore necessary to impart to the single push-in connecting piece a total force comprising the force required for inserting the insulated wire into and along the length of the insulation-piercing fork of the contact, plus the force required to insert the insulated wire into and along the calibrated gripping slit.

The double push-in piece has two pairs of elongate members arranged side by side and two guiding Vees both on the same side of the members, all of which are fast with the end actuating head. The total force needed to operate the double push-in piece is twice that needed for the single push-in piece. It may be at the limit of finger force when actuating the double push-in piece from its withdrawn position to its inserted position.

OBJECT AND SUMMARY OF THE INVENTION

The object of the present invention is to make it easier to actuate a push-in connecting piece, particularly a double one, without at the same time adversely affecting the quality of the connection of each wire to its contact or the mechanical strength of the wire at its contact.

The invention provides a push-in piece for connecting an insulated wire to an insulation displacement contact, comprising an end actuating head and at least one pair of longitudinal elongate members arranged opposite each other, integral with the said head and having mutually aligned holes for inserting the insulated wire, wherein the two elongate members of each pair are also provided with respective mutually aligned calibrated slits for gripping the insulated wire, opening out into the holes of the elongate members, and directed towards said head.

The invention also provides a terminal strip equipped with such push-in connecting pieces, consisting of an insulating body, chimneys defined in the insulating body and opening into a "front" face of said body, insulation displacement contacts fitted in the insulating body, each extending into one of the chimneys and having an insulation-piercing fork with its open end facing towards said front face, and said push-in pieces fitted in the insulating body such as to slide in said chimneys and over said contacts, between an inserted, connecting position and a "withdrawn" position partly outside the chimneys, in which each of said chimneys has a first wall parallel to the inside contact and provided with an elongate passageway located in front of the insulation-piercing fork of said contact and accommodating the insulated wire connected to said contact, wherein said passageway is an opening closed at both ends and being at least as wide as the diameter of the insulated wire, one of the ends of said opening being substantially closed where it meets the chimney and close to said front face of the insulating body and acting as a back-stop against the forced sliding of the insulated wire, from the gripping slits to the holes in the elongate members of the push-in piece, when the push-in piece is actuated from its inserted position to its withdrawn position.

The terminal strip advantageously has at least one of the following additional characteristics:

Each push-in piece comprises a guiding Vee, arranged facing each pair of elongate members, in a relatively stiff bracket integral with the head, said guideway going right through the bracket only in that portion of the bracket which is in line with the holes and the Gripping slits of the elongate members and extending towards the head along the "outside" face of the bracket.

The insulating body comprises travel-limiting means on the outside of the chimneys for limiting the travel of the push-in pieces, and each push-in piece comprises a flexible arm, fast with said bracket and extending the bracket away from the head, which arm slides in said travel-limiting means and is provided with lateral teeth operable to butt against the travel limiting means.

The insulating body receives contact-breaking dividers between two rows of contacts, which dividers define a wall common to the chimneys of said two rows of contacts and are fitted to slide in the body between a position where contact between the contacts facing one another in both rows and resiliently pressed together in a back part of the body, is not broken, and a position where contact between the same contacts is broken.

BRIEF DESCRIPTION OF THE DRAWINGS

The characteristics and advantages of the invention appear from the description of an embodiment shown in the accompanying drawings, in which.

DETAILED DESCRIPTION OF THE INVENTION

Figure 1:
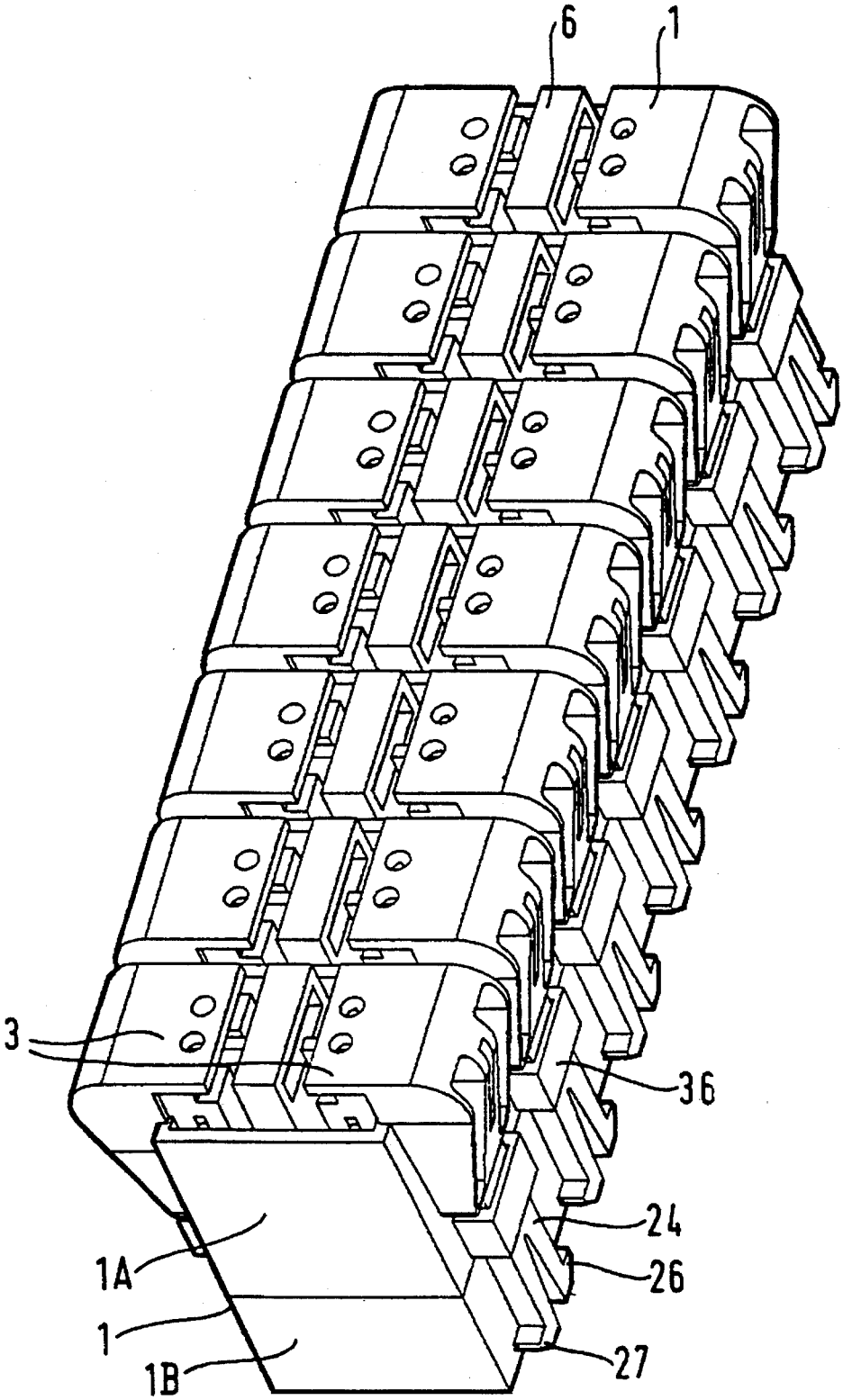
FIG. 1 is a perspective view of a terminal strip of the invention.
Figure 2:
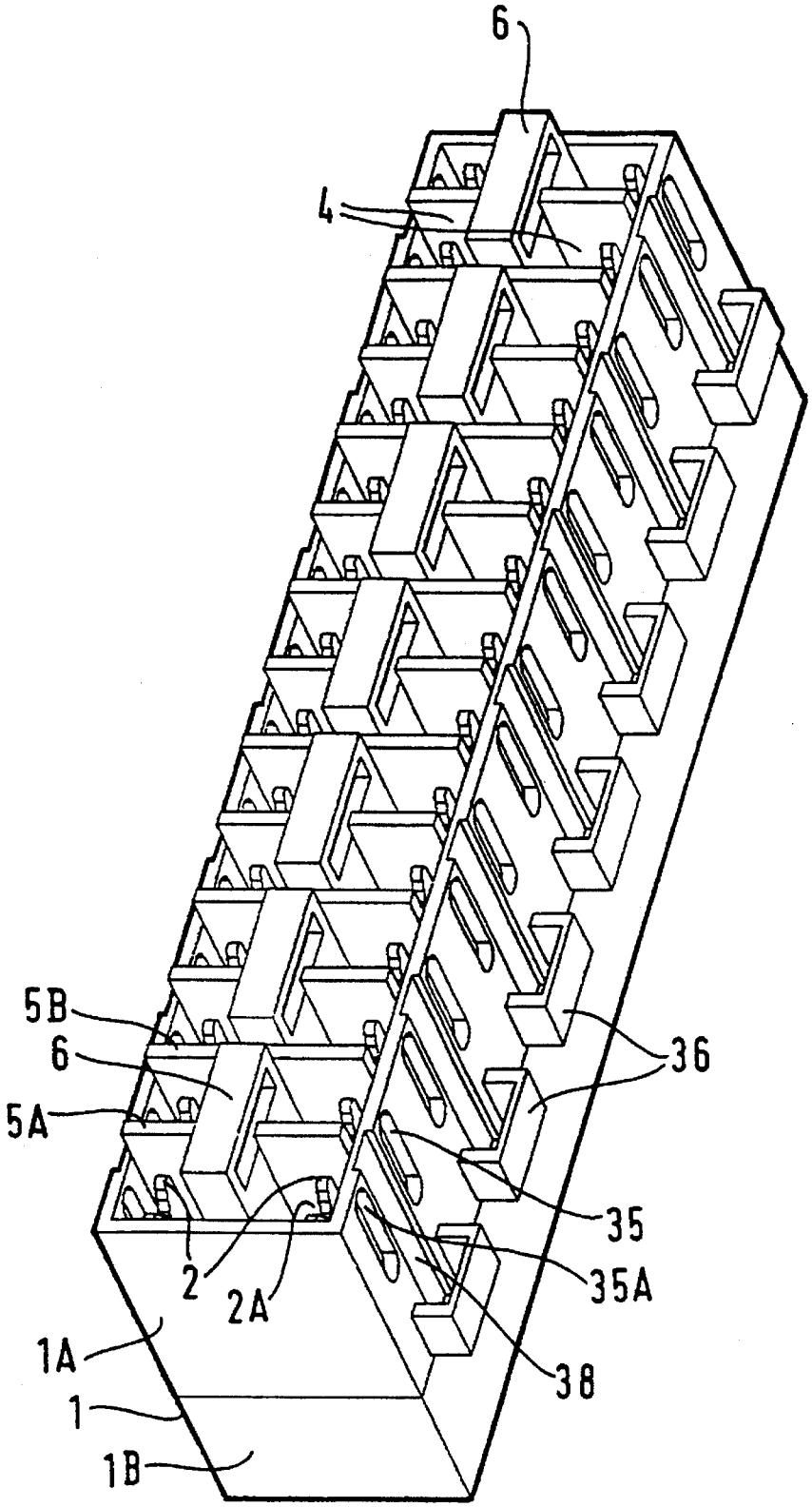
FIG. 2 is a perspective view of the same terminal strip only partly equipped.

Referring now to FIG. 1 or FIG. 2, the terminal strip can be seen to comprise an insulating body 1, in which there are fitted, parallel to its long sides, two rows of insulation-displacement contacts 2, and in which push-in connecting pieces 3 slide. The insulating body has two rows of chimneys 4, open at a front face, for the contacts and the push-in pieces. The chimneys are defined by transverse partitions labelled 5A and 5B which are alternately discontinuous and continuous across the width of the insulating body, and by a longitudinal row of middle partitions 6 common to two chimneys in each of the rows and forming contact-breaking dividers in the terminal strip. The insulated wires to be connected to the contacts are designated below by the numeral 7.

In this embodiment, the body is made in two parts, namely a front part 1A and a back part 1B, which parts are assembled together and in which the contacts extend. This terminal strip is of the type where insulated wires are connected to the contacts with the connection being made entirely from the front face, by the push-in pieces 3. The push-in pieces are accessible from the front face, and here they are double push-in pieces for simultaneously connecting two insulated wires in respective insulation-piercing forks 2A to two adjacent contacts of the same row.

Figure 3:
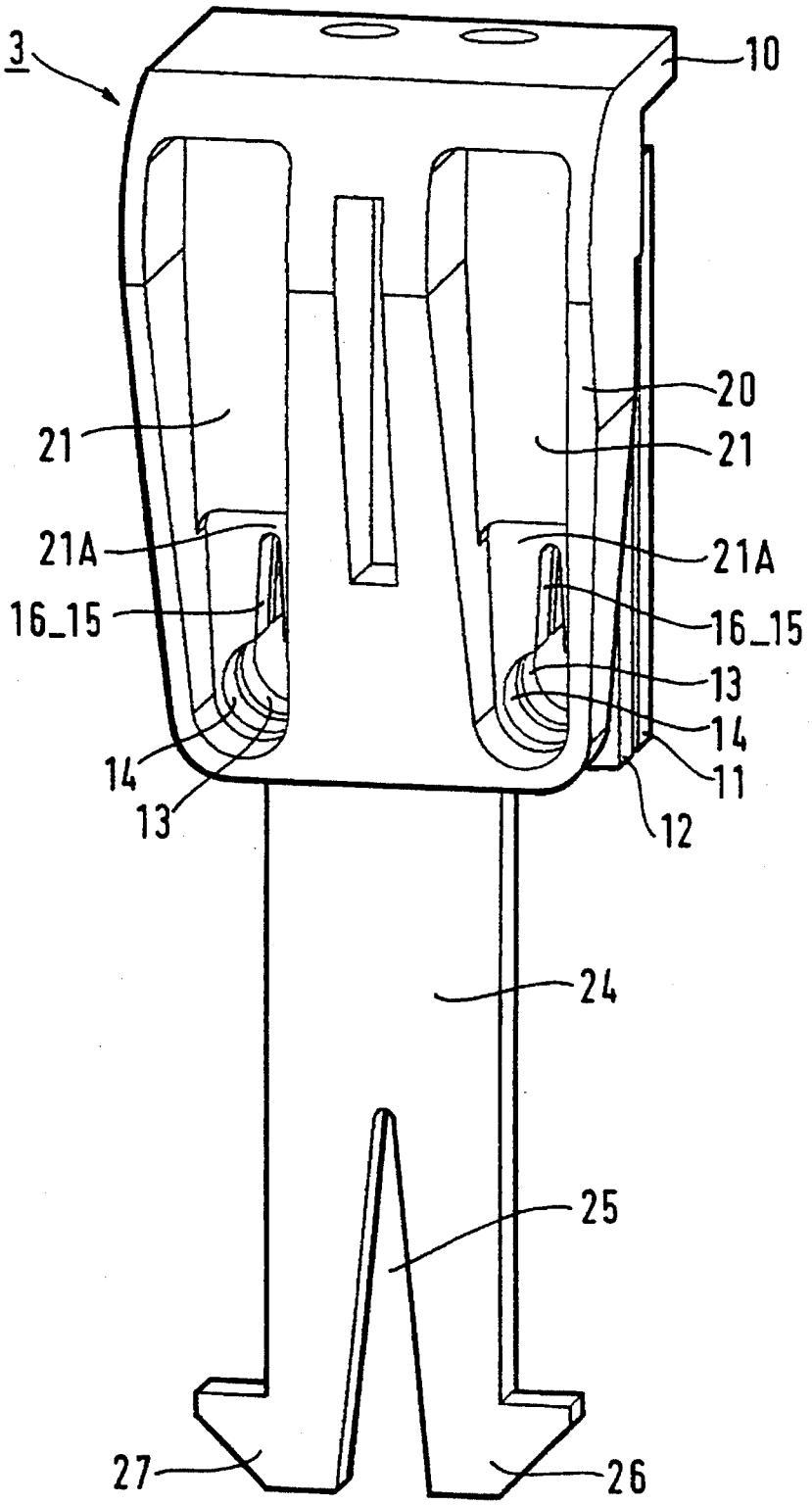
FIGS. 3 and 4 are two perspective views of a push-in connecting piece of the invention, equipping the terminal strip.
Figure 4:
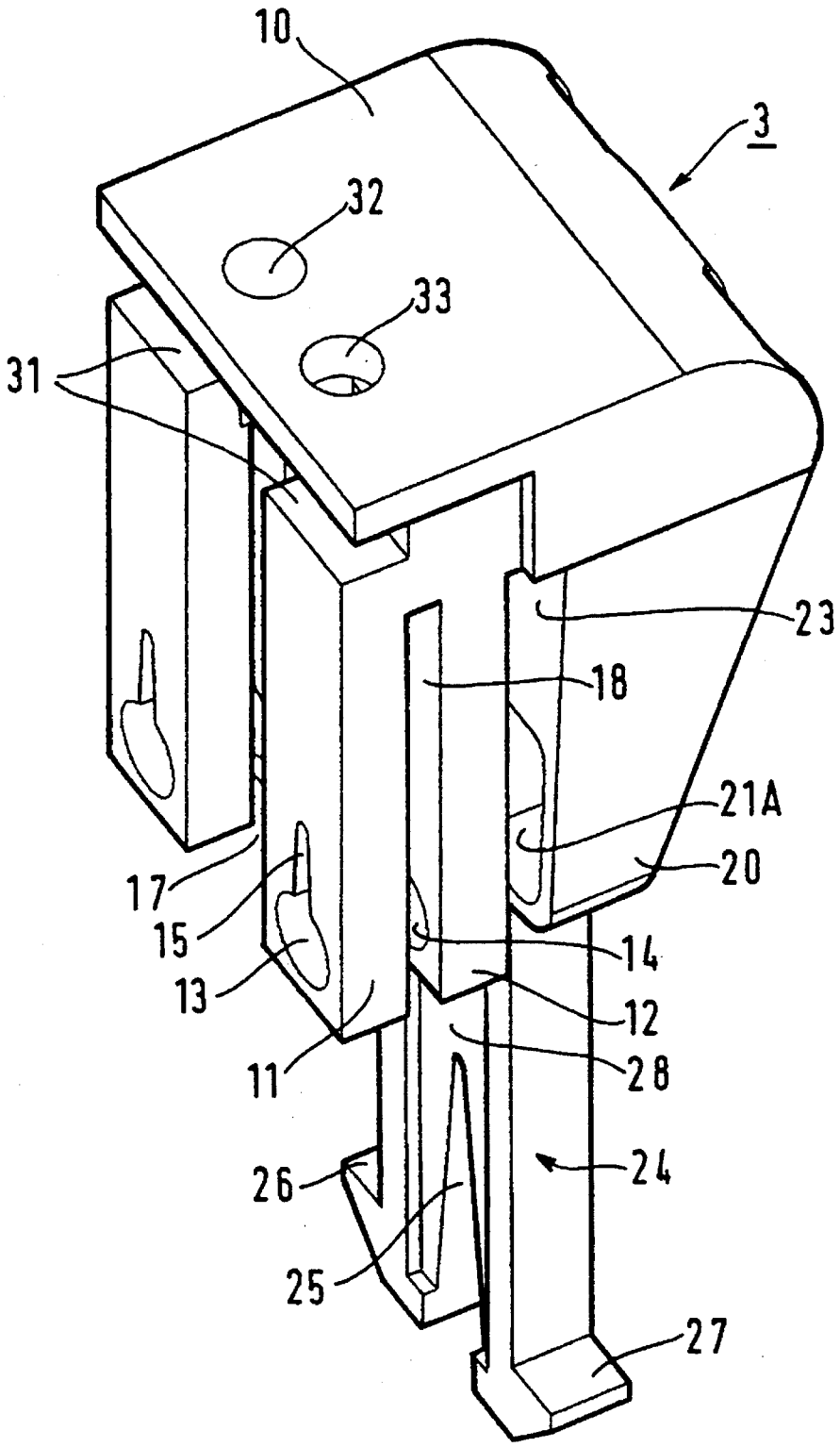

The push-in pieces 3 are all alike and are described in particular with reference to FIGS. 3 and 4, representing one of them.

The push-in piece 3 comprises two pairs of elongate members 11 and 12, labelled identically on both pairs, and fast with an end actuating head 10. The two elongate members of each pair face each other. They both have an identical hole 13 or 14, said holes being mutually aligned, in their end portion away from the head 10, for inserting an insulated wire through each. They also each have a calibrated slit 15 or 16, likewise aligned with the slit in the other elongate member, opening into the hole of the elongate member and directed towards the head, for gripping the insulated wire inserted into the holes and then forced into the gripping slits 15 and 16. The two pairs of elongate members are side-by-side and have a separating slot 17 between them such that they can slide down along the two sides of the transverse partitions 5A of the insulating body (FIG. 2). The two elongate members of each pair also have a separating slot 18 between them such that they can slide down along both sides of the contact.

The push-in piece 3 moreover comprises a relatively stiff bracket 20, extending in front of the two pairs of elongate members and over their length and having two guiding Vees 21 to guide the two insulated wires to be threaded through the holes of the two pairs of elongate members. The innermost portion of each guiding Vee is aligned with the holes 13 and 14 of the two facing elongate members. The innermost portion of the guiding Vee is aligned with the holes 13 and 14 of the two corresponding elongate members, its opening or mouth being towards the head 10 and its branches providing stiffness to the push-in piece. Both guiding Vees go right through the bracket in the area labelled 21A of the Vee, in line with the holes 13 and 14 and the gripping slits 15 and 16 of the two corresponding elongate members but are not through-holes in the end part of the bracket at the head end, where they open out only to the outside.

The bracket 20 and the two pairs of elongate members have a separating slot 23 between them such that the bracket can slide along the outside of two adjacent chimneys of the insulating body when the pairs of elongate members slide inside the two chimneys. The bracket 20 extends at the opposite end from the head into a flexible arm 24 projecting beyond the two elongate members 11 and 12. The projecting arm has a spring-effect slot 25 that opens out in the end of the arm, and two side teeth 26 and 27 are provided on the same end of the arm. The arm is further provided with an axial recess 28 in its inner face, towards the elongate members. The side teeth 26 and 27 limit the travel of the push-in piece when it is pulled out to a withdrawn position above the insulating body.

The head 10 of the push-in piece is slightly proud of the two pairs of elongate members and closes the chimneys of the insulating body. The two outer elongate members not directly in front of the bracket 20 and all like elongate member 11 have a respective end recess forming a notch 31 beneath the head.

Each notch serves to provide a purchase on the push-in piece, particularly for actuating it from its pushed-in position to its withdrawn position.

Two test holes 32 and 33 are also provided passing through the head and each opening onto the bottom of one of the slots such as 18 between the two elongate members of the same pair, near the inner, recessed end of the bottom of each of these slots.

The particular features provided on the insulating body of the terminal strip to correspond with the features of the push-in connecting piece are particularly described with reference to FIGS. 1, 2 and 5.

The insulating body 1 presents a series of oblong holes 35 alongside each row of contacts. Each oblong hole aligned with the insulation-piercing fork of one of the contacts and is made in one of the walls of the chimney parallel to the contact. In this embodiment, which has two rows of contacts and breaking dividers 6 defining walls between the rows that are common to the facing chimneys, the oblong holes are made in the long side partitions of the insulating body. The ends 35A of these oblong holes located towards the front face are closed. They are aligned with the entry of the insulation-piercing forks of the contacts and they are designed to be aligned with the holes 13 and 14 provided in the elongate members of the push-in pieces, when they are in a withdrawn position.

The insulating body 1 is provided, on its long walls, with a series of staple-like retainers 36 associated with the various push-in pieces. The retainers 36 are slightly proud. Each of them receives the arm 24 of one of the push-in pieces and allows said arm to slide against the body wall when the push-in pieced is being pushed in and serves to retain it against upward motion the teeth 26 and 27 on said arm when the push-in piece arrives at the thus limited withdrawn position.

The outside of the long walls of the insulating body is further provided with a series of recesses 38 opening out to the front face. Each of said recesses is centered between the two chimneys receiving one of the push-in pieces and corresponds with the recess 28 in the push-in piece. The recesses 38 and 28 align facing one another and prevent the partitions being juxtaposed and thus lengthen creepage distances. They also permit evaporation of any moisture that might be channelled along the outside of the chimneys.

Figure 5:
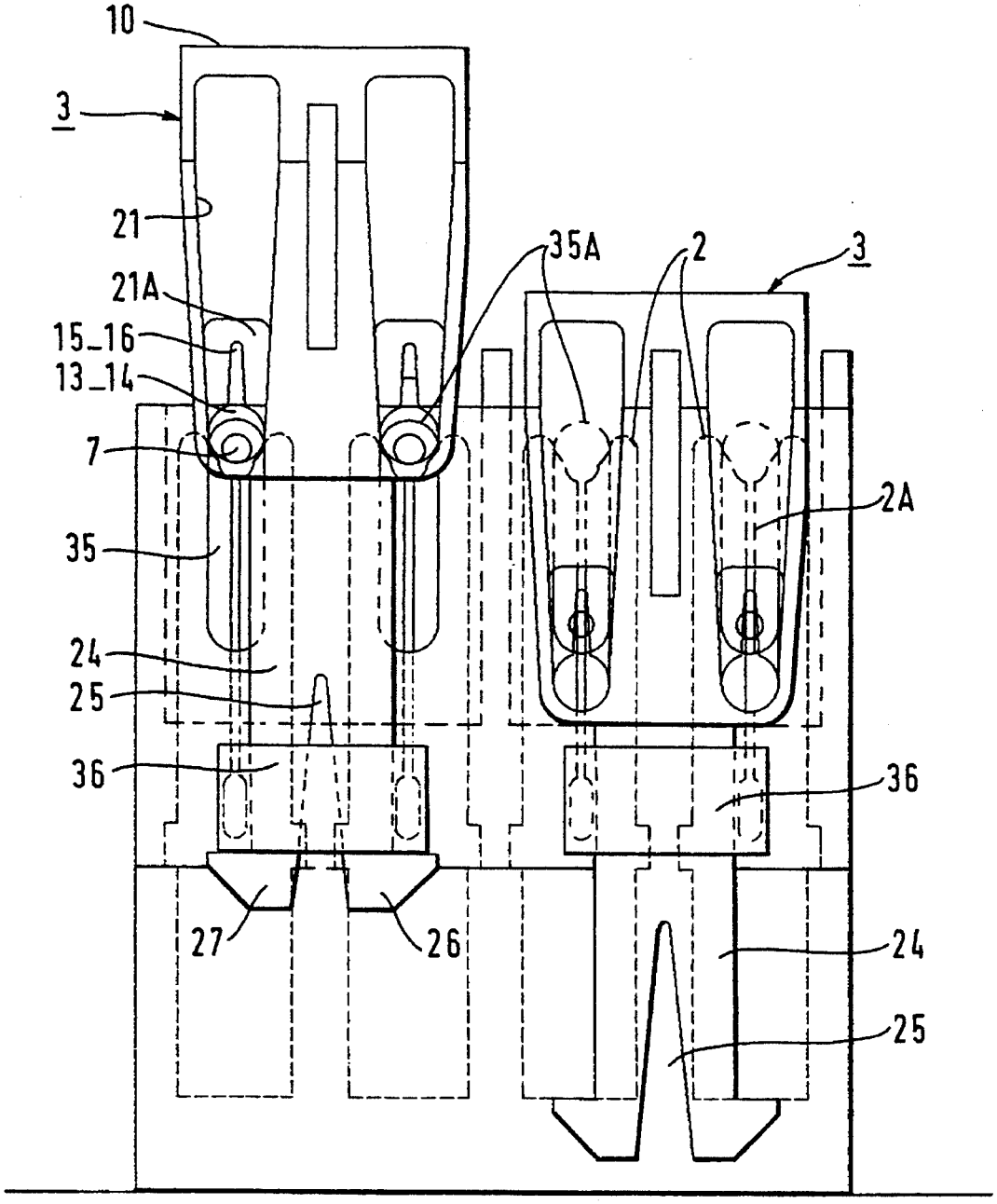
FIG. 5 is a partial view in plan of one of the long sides of terminal strip.
Figure 6:
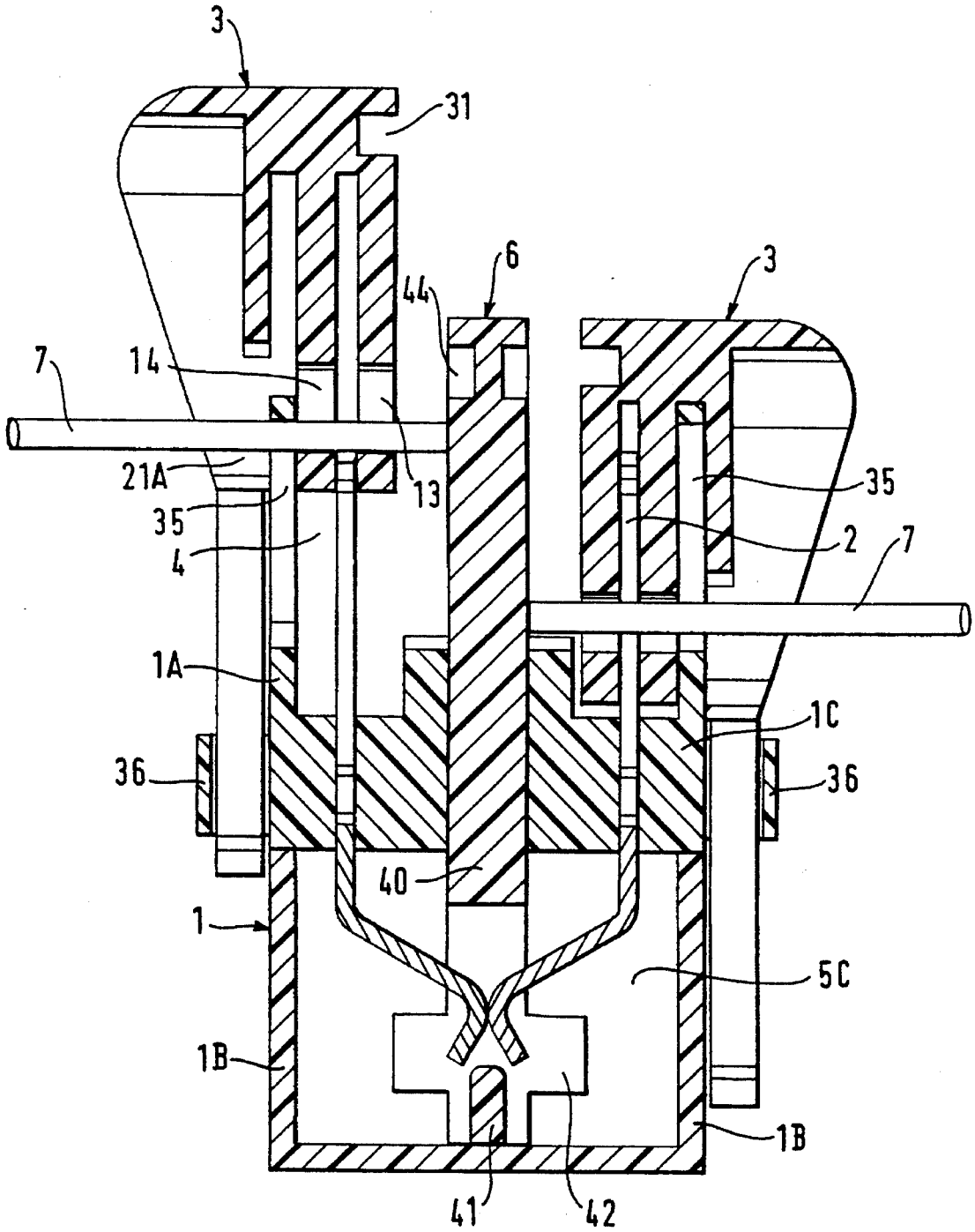
FIG. 6 is a cross-sectional view of the terminal strip.

FIGS. 5 and 6 serve to detail the functions performed by the push-in pieces and the terminal strip equipped with same.

To connect two insulated wires 7 to two adjacent contacts, the push-in piece 3 concerned is placed in fully withdrawn position, in which the two side teeth 26 and 27 are in abutment against further retraction by the staple-like retainer 36 on the outside of the two corresponding chimneys, as shown on the left-hand side of FIGS. 5 and 6. The wires 7 are inserted one after the other into the holes of the elongate members, using the corresponding guiding Vee 21 as a guide to thread each wire more easily into its hole. Each wire is simultaneously received in the end 35A of the oblong hole 35. Connection of the two wires to the two contacts 2 is accomplished by pressing on the push-in piece. Each of the wires then penetrates firstly into the Gripping slits 15 and 16 provided in the elongate members and thereafter into insulation-piercing fork of the contact.

To disconnect the two wires previously connected to the two contacts, a screwdriver or like tool is advantageously used, by placing it in the notches 31 of the push-in piece in pushed-in position and levering up the push-in piece against the contact-breaking divider 6, at least during the first part of its travel to withdrawn position. This method of actuation makes it possible to leave only small Gaps between the heads of the push-in pieces or between the heads and the dividers on the front face of the terminal strip. During actuation towards the withdrawn position, the two insulated wires come out of the two piercing forks 2A of the two concerned contacts and thereafter out of the Gripping slits 15, 16 of the elongate members, as soon as the force clamping them in the Gripping slits is Greater than the force clamping them in the piercing forks. The closed ends 35A of the two oblong holes 35 in which the wires slide as they become disconnected ensure that they are both fully extracted from their Gripping slits. The wires can then be extracted without resistance from the holes 13 and 14 into which they have been returned.

FIG. 6 shows moreover that the contacts Go through a base 1C of the front part 1A of the insulating body, and are retained in said base, and that two facing contacts in the two rows are resiliently pressed one against the other in the back part 1B of the insulating body.

This back part is compartmentalized transversely by partitions 5C, spaced at a pitch which is double that of the partitions in the front part 1A of the insulating body 1 and corresponding solely with the transverse partitions 5B (FIG. 2) previously described as being continuous across the width of part 1A, and it is compartmentalized longitudinally by the breaking dividers 6. The dividers pass through the base 1C and are slidable therein. Each serves to break or make contact between two pairs of facing contacts in the two rows.

Figure 7:
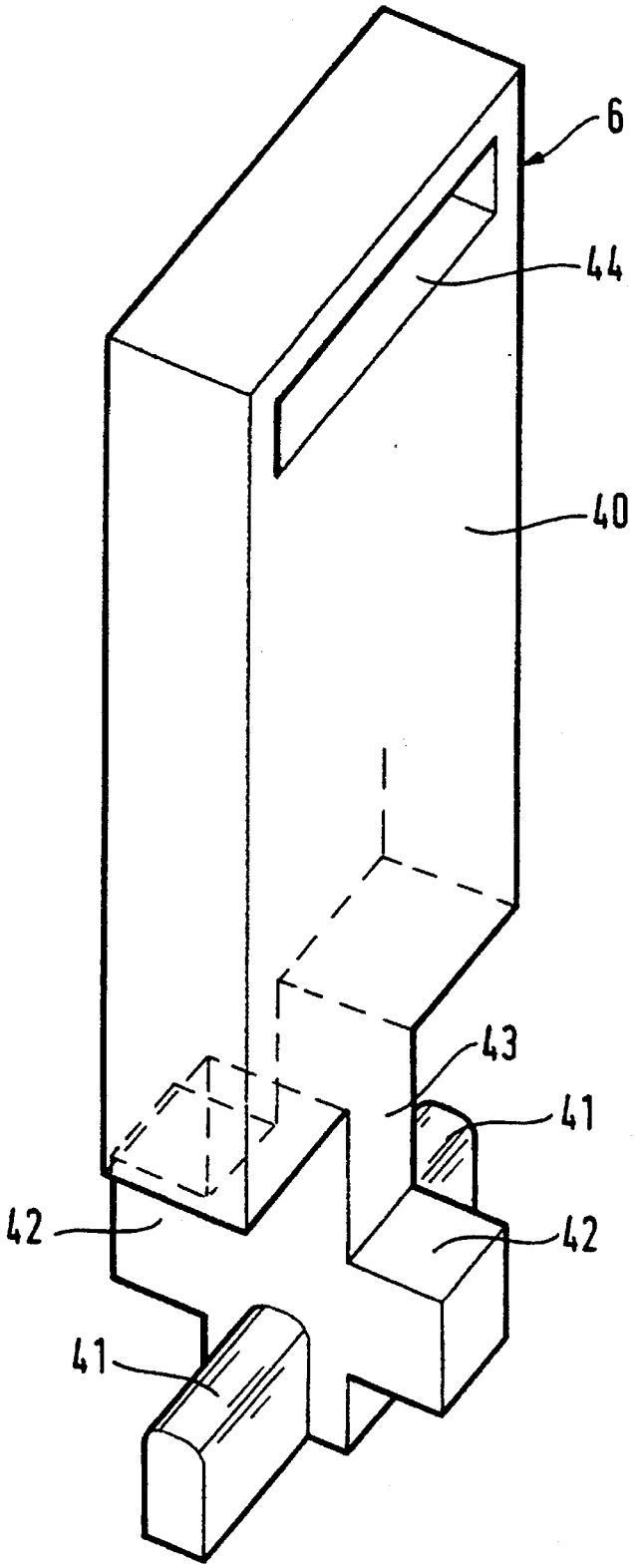
FIG. 7 is a perspective view of a contact-breaking divider in the same terminal strip.

One such divider is shown in FIG. 7.

The divider is made of an insulating material. It is made as a small rectangular plate 40 having a pair of contact-breaking arms 41 and a pair of abutment arms 42, said arms being mutually fast, and a connecting member 43 to the divider plate 40. The arms 41 lie in the plane of the of plate and the arms 42 are arranged crosswise to it. Together the two pairs of arms define a "back" end of the divider going into the back end of the insulating body. One of the arm pairs, the arms 41 in this example, provides guidance for the divider in the back portion, in other words between two partitions 5C. This pair of arms is made for this purpose substantially equal in length to the corresponding dimension of each compartment of the back portion.

The contact-breaking arms 41 have rounded sides facing the plate so that they penetrate more easily between the resiliently pressed-together contacts. The arms 42 are rectangular in cross-section and are intended to limit the travel of the divider when it is being placed into contact-breaking position, by striking against the base of the front part of the insulating body.

The breaking divider 6 is provided with two notches 44 in its broad sides, in the "front" end thereof and specifically almost at the very end thereof, used to actuate it into the contact-breaking position.

Referring again to FIG. 6, it can be readily understood that when the divider is pushed fully home into the insulating body it is in contact-making position. It can easily be actuated to the contact-breaking position with the help of a screwdriver or like tool inserted into one of the notches 44 and using either of the two push-in pieces in pushed-in position on either side of the divider as a fulcrum.

Each breaking divider also serves as a backstop for the ends of wires inserted into one or the other of the push-in pieces on either side.

As an alternative embodiment to the one illustrated, it is obvious that the push-in pieces for connecting and gripping each insulated wire in line with the contact to which said wire is connected can be single push-in pieces.

In another alternative embodiment, the terminal strip equipped with push-in connecting pieces can comprise a plurality of double rows of contacts, each double row being identical to the one of the terminal strip illustrated, with a middle row of associated contact-breaking dividers, or it can comprise any number of rows of contacts, with each contact accessible from the front face and the back face and not pressed against the facing contact and without any breaking dividers between them.

In still another alternative embodiment the single or double push-in pieces may be equipped with teeth to retain them in withdrawn position, not in this case on the outside of the corresponding chimneys but rather on the inside of said chimneys. These retaining teeth can thus be made on the sides of the sole pair of elongate members or on the two pairs or on an arm extending from one of the elongate members of the sole pair or of each of the two pairs, to engage with corresponding stops provided in this case on the inside of the insulating body.

The invention claimed is:

1. A push-in piece for connecting an insulated wire to an insulation displacement contact by sliding said push-in piece onto said contact, said push-in piece comprising an end actuating head and at least two longitudinal elongate members which face each other, said at least two longitudinal elongate members having first end portions formed integrally with said end actuating head and having second, free end portions formed with mutually aligned holes for inserting the insulated wire, wherein said at least two elongate members are also provided with respective mutually aligned gripping slits, for gripping the insulated wire, opening out into the respective holes of the elongate members and extending from the respective holes towards said end actuating head.

2. A terminal strip according to claim 1, in which said push-in piece further comprises a guiding Vee, arranged facing said at least two elongate members and having a bottom aligned with the holes in the elongate members and branches integral with said head, wherein said guiding Vee is made in a relatively stiff bracket integral with said head and goes right through said bracket only in that portion of the Vee which is located substantially in line with the holes and the gripping slits of the elongate members, but solely on the face opposite from an outer face of said bracket facing the at least two elongate members, and on the other part of the Vee located on said head side.

3. A terminal strip equipped with push-in connecting pieces, each push-in piece for connecting an insulated wire to an insulation displacement contact by sliding said push-in piece onto said contact, each push-in piece comprising an end actuating head and at least two longitudinal elongate members which face each other, said at least two longitudinal elongate members having first end portions formed integrally with said end actuating head and having second, free end portions formed with mutually aligned holes for inserting the insulated wire, wherein the at least two elongate members are also provided with respective mutually aligned gripping slits, for gripping the insulated wire, opening out into the respective holes of the elongate members and extending from the respective holes towards said end actuating head, said terminal strip comprising:

an insulating body, chimneys defined in the insulating body and opening out into a front face of said insulating body, a plurality of insulation-displacement contacts fitted in the insulation body, each extending into one of the chimneys and having an insulation-piercing fork with its open end facing towards said front face, and said push-in pieces fitted in the insulating body so as to slide in said chimneys and over said contacts, between an inserted, connecting position and a withdrawn position partly outside the chimneys, in which each of said chimneys has a first wall parallel to an inside contact and provided with an elongate passageway located in alignment with the insulation-piercing fork of a corresponding one of said contacts and accommodating a corresponding said insulated wire connected to said corresponding contact, wherein said elongated passageway is a through-opening closed at both ends and being at least as wide as the diameter of the corresponding insulated wire, one of the ends of said through-opening being substantially closed where it meets the chimney, proximate to said front face of the insulating body, and serving as a back-stop against the forced sliding of the corresponding insulated wire, from the gripping slits to the holes in the elongate members of the corresponding push-in piece, when the corresponding push-in piece is actuated from the inserted position to the withdrawn position.

4. A terminal strip according to claim 3, wherein each of said push-in pieces has a notch between the at least two elongate members and said head, for actuating the corresponding push-in piece to the withdrawn position with the help of a tool inserted in the notch.

5. A terminal strip according to claim 3, wherein recesses are provided in outside partitions, of the chimneys, one end of which opens onto the front face of the insulating body.

6. A terminal strip according to claim 3, in which each push-in piece further comprises a guiding Vee, arranged facing the at least two elongate members and having a bottom aligned with the holes in the elongate members and branches integral with said head, wherein said guiding Vee is made in a relatively stiff bracket integral with the said head and goes right through said bracket only in that portion of the Vee which is located substantially in line with the holes and the gripping slits of the elongate members, but solely on the face opposite from an outer face of said bracket facing the at least two elongate members, and on the other part of the Vee located on said head side.

7. A terminal strip according to claim 6, comprising means for limiting the travel of the push-in pieces in a withdrawn direction, wherein said means for limiting the travel comprises staple-like retainers projecting on an outside of the first walls of said chimneys and a flexible arm, integral with said bracket portion of each push-in piece and extending the bracket axially in a direction away from said head, said flexible arm being provided with two lateral teeth and being slidingly received in one of the retainers, limiting the travel of the corresponding push-in piece by said teeth butting against the retainer.

8. A terminal strip according to claim 7, wherein a longitudinal recess is provided in a face of said flexible arm facing the elongate members.

9. A terminal strip according to claim 3, further comprising a row of contact-breaking dividers arranged between two rows of facing contacts and fitted to slide individually in said insulating body between a contact breaking position where said dividers break the contact between the facing contacts and a non-breaking position where said dividers do not break the contact between said facing contacts, said dividers forming second walls opposite the first walls of the chimneys of the two rows of contacts and back-stops for the respective insulated wires inserted into the push-in pieces, the facing contacts of the two rows being resiliently pressed together in a back part of the insulating body, when the contact-breaking divider between them is in the non-breaking position and being separated when the divider between them is in the contact-breaking position.

10. A terminal strip according to claim 9, wherein each contact-breaking divider comprises at least one notch in one of its end portions, corresponding to the front portion in the insulating body, for actuating it to the contact-breaking position.

11. A terminal strip according to claim 9, wherein each divider is associated with two contacts in each of the two rows and is a rectangular box-shaped plate having a central connecting member on a back one of its edges in the insulating body, two oppositely directed, contact-breaking arms in the plane of said plate and two other abutment arms oppositely directed with respect to each other and perpendicular to the first, all arms being attached to said connecting member.

* * * * *